US005775564A

United States Patent [19]

Ilmarinen

[11] Patent Number: 5,775,564

[45] Date of Patent: Jul. 7, 1998

[54] METHOD AND APPARATUS FOR REDUCING WEAR OF A BELT MANTLE OF AN EXTENDED-NIP ROLL

[75] Inventor: Antti Ilmarinen, Jyväskylä , Finland

[73] Assignee: Valmet Corporation, Helsinki, Finland

[21] Appl. No.: 783,334

[22] Filed: Jan. 16, 1997

[30] Foreign Application Priority Data

Oct. 25, 1996 [FI] Finland ..... 964296

[51] Int. Cl.[6] ..... B65H 20/00; D21H 11/00; D21F 3/00; D21F 11/00

[52] U.S. Cl. ..... 226/171; 226/174; 226/179; 226/190; 162/205; 162/358.3

[58] Field of Search ..... 226/168, 171, 226/174, 179, 186, 190, 192; 162/358.3, 358.4, 358.5, 205, 272

[56] References Cited

U.S. PATENT DOCUMENTS

| | | | |
|---|---|---|---|
| 3,402,101 | 9/1968 | Schiel | 162/205 X |
| 4,861,434 | 8/1989 | Bonander et al. | 162/205 X |
| 5,084,137 | 1/1992 | Ilmarinen et al. | 162/358.3 X |
| 5,496,442 | 3/1996 | Laapotti | 162/358.3 X |
| 5,643,416 | 7/1997 | Lange et al. | 162/358.3 X |

FOREIGN PATENT DOCUMENTS 0527881 2/1992 European Pat. Off. .

*Primary Examiner*—Michael Mansen

*Attorney, Agent, or Firm*—Steinberg, Raskin & Davidson, P.C.

[57] ABSTRACT

A method and apparatus for reducing the wear of the belt mantle of an extended-nip roll including a resilient belt mantle arranged to revolve on support of bearings around a stationary central axle. The central axle has loading members connected with it, such as a loading shoe, which are pressed by the pressure of a loading medium, such as hydraulic fluid, towards a backup roll, whereby the belt mantle conforms to the shape of the backup roll in the area of the shoe. Actuators connected with the ends of the belt mantle are provided and act with a force upon the ends of the belt mantle of the extended-nip roll so that the direction of stretching of the belt mantle of the extended-nip roll is reversed alternatingly by controlling the actuators and/or locking devices which lock the ends of the belt mantle.

26 Claims, 10 Drawing Sheets

METHOD AND APPARATUS FOR REDUCING WEAR OF A BELT MANTLE OF AN EXTENDED-NIP ROLL

FIELD OF THE INVENTION

The invention relates to a method and apparatus for reducing wear of a belt mantle of an extended-nip roll.

BACKGROUND OF THE INVENTION

In an extended-nip press, one particular problem is the wear of the belt mantle of the extended-nip roll in the areas of the ends of the glide shoe. From the current assignee's European Patent No. 0 527 881 of prior date, an apparatus is known in which the belt is shifted axially in only one direction by means of mechanical stops manually, in practice, approximately once in a week. The tightening of the belt takes place by means of hydraulic cylinders. The hydraulic cylinders are fitted to act upon one end of the belt only, and the other end of the belt is kept permanently locked in its place. After the belt mantle has stretched over a certain distance, the belt mantle is shifted to a new position (while the tightening is effective all the time). Generally, the belt mantle must be replaced after an operation of about eight months. The apparatus for stretching a belt mantle is used for operational reasons in order to maintain the shape of the belt mantle. In the construction disclosed in EP 0 527 881, the stretching of the belt mantle is not taken advantage of in any way, but the equipment for stretching the belt mantle is used exclusively in order to permit the operation of the belt mantle when the belt mantle tends to stretch normally in operation.

OBJECTS AND SUMMARY OF THE INVENTION

It is an object of the present invention to provide a new and improved method and apparatus for reducing wear of a belt mantle of an extended-nip roll.

It is another object of the present invention to provide an improvement of the method known from the above-described European Patent No. 0 527 881.

In order to achieve these objects and others, in the method and apparatus in accordance with the invention, the direction of stretching of the belt is reversed automatically, i.e., the belt mantle is alternatingly stretched in opposite direction, after a certain distance or period of stretching. Thus, in one preferred embodiment of the method of the invention, one end of the belt is locked first, and the other end of the belt is acted upon by a cylinder device to stretch the belt in a first direction. After this, the other end of the belt is locked, and the belt is stretched in a second, opposite direction, i.e., the direction of stretching of the belt is reversed while the end of the belt mantle which is locked is also reversed. For example, after twenty-four hours, the end of the belt at the tending side of the paper machine is made free and, correspondingly, the end of the belt at the driving side of the paper machine is locked. In the construction in accordance with the invention, stretching of the belt is utilized in order to shift the wear areas placed at the ends of the loading shoe of the belt mantle in an extended-nip roll. The wear areas of the belt mantle are understood as meaning the areas in the belt that are placed in the lateral areas of the loading shoe.

If necessary, the extent of stretching can be controlled by means of the pressures in the tightening cylinders, and it is possible to shift the entire belt axially. The length and the position of the belt can be monitored by means of distance detectors. The locking of the belt can be carried out, for example, by means of mechanical, hydraulic, magnetic, or pneumatic locking elements.

In the construction in accordance with the invention, the belt mantle is stretched first in one direction, and after that in the other direction. The stretching direction is varied by controlling actuators, such as hydraulic cylinders and/or separate locking means connected to the ends of the belt mantle. In certain embodiments of the invention, one end of the belt mantle is first kept locked, whereas the other end is stretched. After that, the opposite end of the belt is kept locked and the other end is stretched. The locking of the belt mantle can be carried out, for example, by locking a valve connected with a cylinder, preferably a hydraulic cylinder. A more rigid locking is obtained when separate locking devices are used. For example, it is possible to use a separate spindle, which is positioned against the front face of a mobile flange connected with the belt mantle. In a locking situation, the flange of the belt mantle connected with the belt end at the locking side is pressed against the spindle by means of an actuator, preferably a hydraulic cylinder, and a loading force is applied to the opposite, freely moving end of the belt mantle by means of a second actuator, preferably a hydraulic cylinder, in order to stretch the belt mantle.

Within the scope of the invention, an embodiment is also possible in which the belt mantle can be oscillated besides stretching. In such a case, when the direction of stretching is reversed, the direction of oscillation of the belt mantle is also reversed. The oscillation is preferably carried out by means of two hydraulic cylinders so that different pressures are applied to the hydraulic cylinders at different sides.

In one basic embodiment of the method for reducing wear of a resilient belt mantle of an extended-nip roll in accordance with the invention, the extended-nip rolls includes a stationary central axle, bearings for revolvingly supporting the belt mantle on the central axle, a loading shoe arranged in the belt mantle, and loading means arranged on the central axle for pressing the loading shoe toward a backup roll arranged in nip-defining relationship with the extended-nip roll. In the method, a first set of at least one actuator is coupled to a first end of the belt mantle and actuatable to apply a force to the first end of the belt mantle such that the belt mantle is stretchable in a first direction, a second set of at least one actuator is coupled to a second end of the belt mantle and actuatable to apply a force to the second end of the belt mantle such that the belt mantle is stretchable in a second direction opposite to the first direction, and the actuation of the actuators is controlled such that the belt mantle is alternatingly stretched in the first direction and the second direction. The first end of the belt mantle may be locked when the actuator(s) in the second set is actuated, and the second end of the belt mantle may be locked when the actuator(s) in the first set is actuated.

In certain embodiments, a first flange is arranged at a first axial end of the roll axle for retaining the first end of the belt mantle and is arranged on the central roll axle whereby the actuator(s) of the first set is arranged to apply a force upon activation or actuation to the first flange, and a second flange is arranged at a second axial end of the roll axle for retaining the second end of the belt mantle and is arranged on the roll axle whereby the actuator(s) of the second set is arranged to apply a force upon activation or actuation to the second flange. In this case, the first flange may be locked in its position when the actuator(s) in the second set is actuated, and the second flange locked in its position when the actuator(s) in the first set is actuated. The stretching of the belt mantle can optionally be monitored by detecting the displacement of the first and second flanges. One manner to accomplish this is to supply a medium to the actuator(s) in the first set through a valve to actuate the same, supply a medium to the actuator(s) in the second set through the valve to actuate the same, and control the valve such that when the medium flows to the actuator(s) in the first set, flow of the medium to the actuator(s) in the second set is prevented so that it is locked, and when the medium flows to the actuator (s) in the second set, flow of the medium to the actuator(s) in the first set is prevented so that it is locked.

BRIEF DESCRIPTION OF THE DRAWINGS

The following drawings are illustrative of embodiments of the invention and are not meant to limit the scope of the invention as encompassed by the claims.

FIGS. 2A and 2B illustrate stretch diagrams of the belt mantle wherein FIG. 2A illustrates a prior art construction and FIG. 2B illustrates a construction according to the present invention.

DETAILED DESCRIPTION OF THE PREFERRED EMBODIMENTS

Figure 1A:
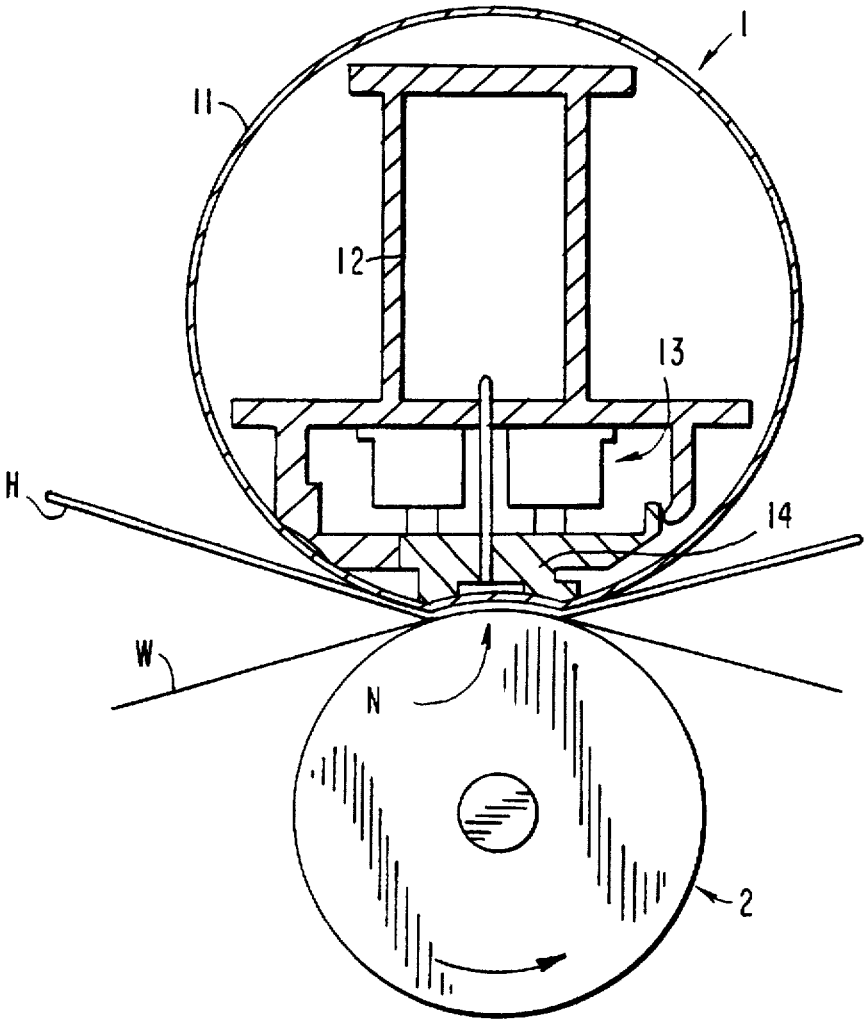
FIG. 1A is a sectional view illustrating the construction of an extended-nip roll viewed from the side in relation to the machine direction.

Referring to the accompanying drawings wherein the same reference numerals refer to the same or similar elements, FIG. 1A is a sectional view illustrating the construction of an extended-nip roll 1. The extended-nip roll 1 forms a nip N with a backup roll 2. The extended-nip roll 1 comprises a belt mantle 11, which is a resilient deformable mantle and defines the roll, which adopts a shape in the nip zone determined by a loading shoe 14 arranged in the extended-nip roll 1, i.e., within the interior of the mantle 11, and by the backup roll 2. Loading means 13 are arranged on a central axle 12 of the extended-nip roll 1 and press the loading shoe 14 toward and against the backup roll 2. A web W and a felt H are passed through the nip N.

Figure 1B:
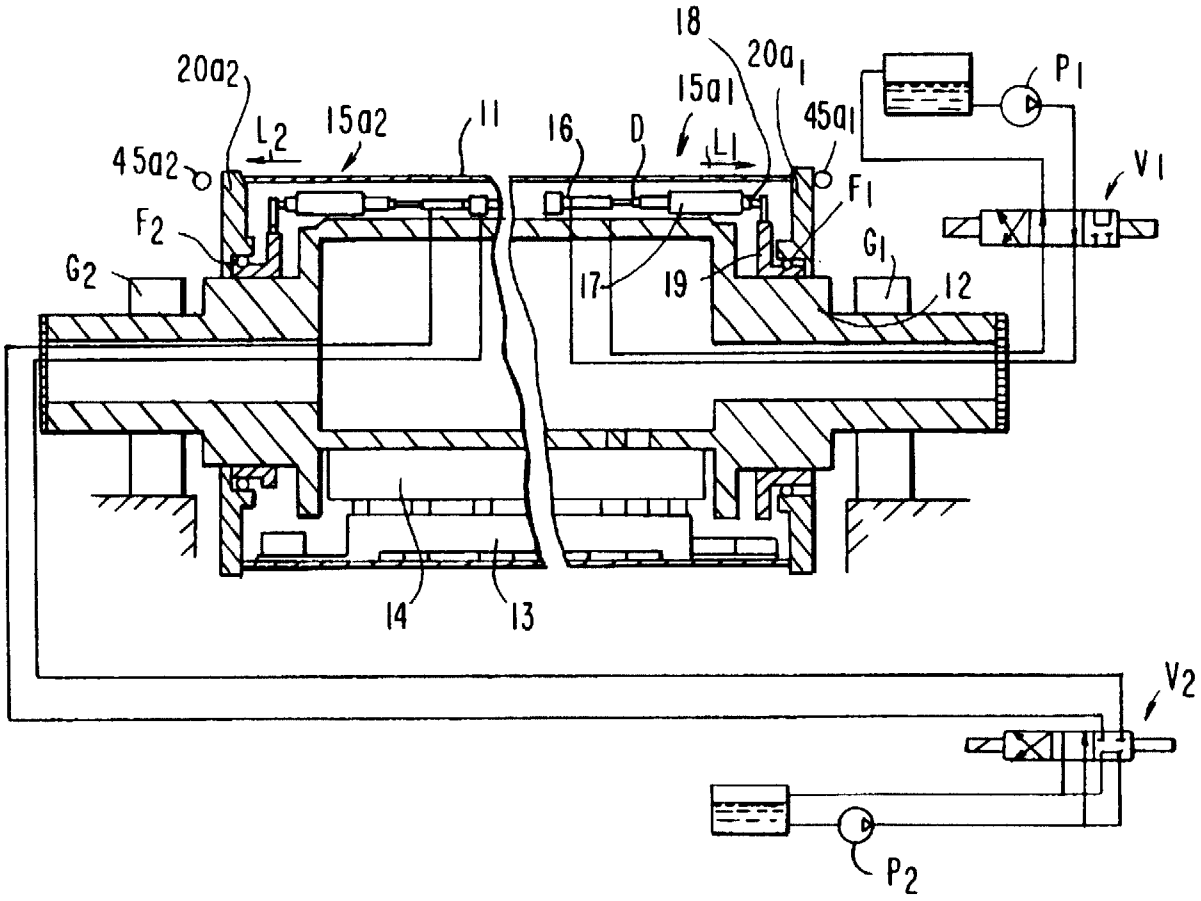
FIG. 1B is a longitudinal sectional view illustrating the extended-nip roll of an extended-nip press as shown in FIG. 1A.

FIG. 1B is a schematic sectional view of the upper extended-nip roll 1 shown in FIG. 1A, and, in accordance with the invention, the construction shown in FIG. 1B comprises actuating means such as two sets of actuators $15a_1$, and $15a_2$ for stretching the belt mantle 11 of the extended-nip roll 1 alternatingly in opposite directions, namely in the directions $L_1$ and $L_2$. There may be one or more actuators in each set whereby a first set is situated on the right in the illustrated embodiment and a second set is situated on the left in the illustrated embodiment.

Figure 1C:
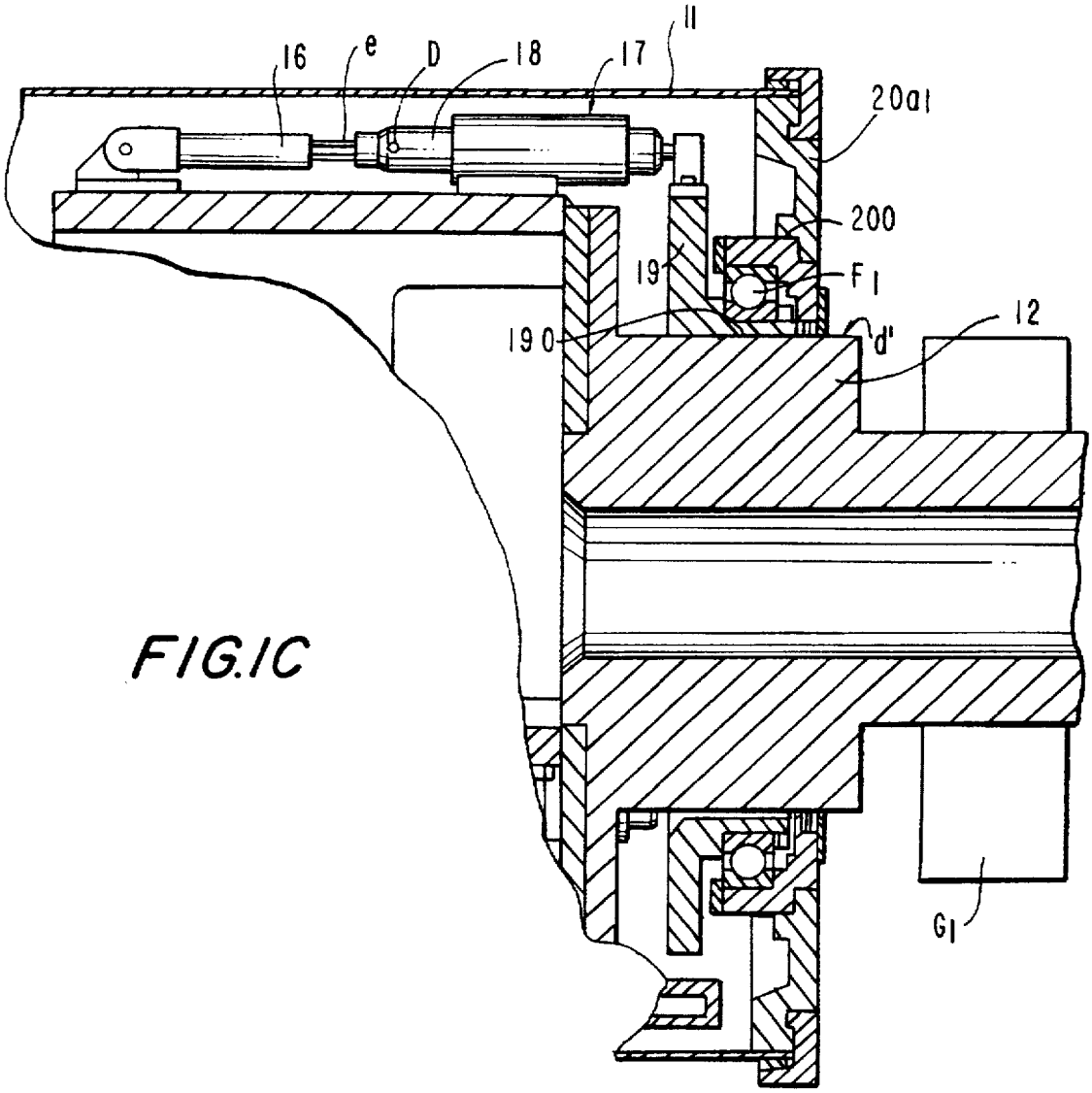
FIG. 1C is a sectional view on an enlarged scale of one end of an extended-nip roll in the area of the actuator $15a_1$.

In the embodiment shown in FIGS. 1A, 1B, 1C, the hydraulic actuators $15a_1$ and $15a_2$ can also operate as locking means, in which case, when one actuator $15a_1$ is being loaded to stretch one end of the belt mantle, the other actuator(s) $15a_2$ is kept in the locked state, whereby they lock the other end of the belt mantle preventing movement thereof, and similarly the actuators can be controlled to provide the reverse situation. Separate locking means will also be described below with reference to FIGS. 4A and 4B, by whose means the locking of the ends of the belt mantle 11 of the extended-nip roll can be carried out separately.

As shown in FIG. 1B, each actuator $15a_1$, comprises a loading cylinder 16, which is connected through an articulated joint D with an extension arm 18 guided in a slide 17. The extension arm 18 is connected with a flange 19, which is further connected operationally with the end flange $20a_1$ of the belt mantle 11, i.e., the end flange retaining the associated end of the belt mantle 11. Between the end flange 20a, and the axle 12, there is a glide fitting. A glide fitting is also provided between the flange 19 and the axle 12. The actuators $15a_2$ have a similar structure. Thus, when the actuator $15a_1$ or $15a_2$ acts upon the belt mantle 11 in a way that stretches it, either one of the ends of the belt mantle 11, i.e., the end flange $20a_1$ or $20a_2$, is affected. Bearing means $F_1$ are placed between an extension shoulder 190 of the flange 19 and a shoulder 200 of the end flange $20a_1$ (FIG. 1C). The belt mantle 11 (secured to the end flanges $20a_1$, $20a_2$) is fitted to revolve on support of the bearing means F.

Pumps $P_1$ and $P_2$ are associated with the respective actuators $15a_1$,$15a_2$ for supplying a pressure medium or hydraulic medium thereto in order to activate or actuate the same and can also be substituted for by one common pump. The actuators will not exert any significant force to stretch the belt mantle in the absence of a flow of medium thereto. The hydraulic actuator $15a_1$ is operated by means of the pump $P_1$, and through a valve V, the fluid pressure is passed to the hydraulic actuator $15a_1$. Similarly, the hydraulic cylinder $15a_2$ is operated through the pump $P_2$ and a valve $V_2$. The non-revolving static central axle 12 of the extended-nip roll 1 rests on standing bearings $G_1$ and $G_2$ which permit an angular change in the axle 12. The fluid circulation circuit of the actuators $15a_1$, $15a_2$ only is shown. The other fluid circulation circuit in the roll are not shown. It is possible to provide a single valve for controlling the supply of the medium to both sets of actuators.

Thus, as shown in FIG. 1B, when the actuator $15a_1$ acts in the direction of the arrow $L_1$ upon one end of the belt mantle 11 through the flange 20$a_1$, the other hydraulic actuators 15$a_2$ are kept locked, and thereby movement of the other end of the belt mantle 11 is prevented. After the end of the belt mantle upon which the actuator 15$a_1$ acted has moved a certain distance, the distance is detected, for example, by means of an inductive detector device 45$a_1$, and after this the devices 15$a_1$, 15$a_2$ are controlled so that the actuator 15$a_1$ is locked and a force acts, by means of the hydraulic actuator 15$a_2$, upon the opposite end of the belt 1 mantle 11, and thus the belt mantle is stretched from the opposite end. When the hydraulic actuator 15$a_1$ is locked, the hydraulic actuator 15$a_2$ acts with a force through the flange 19 upon the flange 20$a_2$ of the extended-nip roll and, thus, upon the belt mantle 11 connected with the flange 20$a_2$. This action is continued until the entire stretch reserve of the belt mantle 11 has been consumed, and thereupon the belt mantle 11 is replaced. By means of the method described above, the belt mantle 11 can be operated for about 12 months, and thereby economies of several months are obtained compared with prior art methods. Further, in the novel construction of the present invention, the boundary area between the loading shoe 14 and the belt mantle 11 is shifted constantly, and thereby marking of the belt mantle in the end area of the loading shoe 14 is prevented. The detector device 45$a_1$,45$a_2$ can be, for example, an inductive detector, which detects the position of the flange 20$a_1$,2$a_2$ of the belt mantle 11.

There can be two detector devices 45$a_1$, 45$a_2$, in which case the detector devices are placed at opposite ends of the belt mantle. As such, by means of one set of detector devices 45, the position of one end of the belt mantle is detected, and by means of the other set of detector devices the position of the opposite end of the belt mantle is detected. In the embodiments of the invention shown in the drawings, the arrangements of equipment at the ends of the belt mantle 11 are for the most part similar to one another. Thus, the devices 15$a_1$, 15$a_2$ are preferably identical with one another, and so are the operational parts connected with them, such as the flanges 19. It should be understood that different detector devices and actuator devices may of course be used in conjunction with the roll without deviating from the scope and spirit of the invention.

FIG. 1C is a sectional view of an end of an extended-nip roll on an enlarged scale. The actuator 15$a_1$ is preferably a hydraulic actuator, which comprises a hydraulic cylinder loading by means of the loaded pressure of a hydraulic medium, by whose means the flange 19 is acted upon with a force outward relative to the midpoint of the roll, which flange 19 is placed on the shoulder d' of the central axle 12. The flange 19 is arraigned to glide on the shoulder d' of the axle 12. The flange 19 further the extension shoulder 190. The flange 20$a_1$ of the belt mantle 11 of the extended-nip roll is connected with the shoulder 200. The bearing means F are placed between the shoulders 200 and 190 of the flanges. The belt mantle 11 revolves on support of the bearing means F. The flange 20$a_1$ is also arranged to glide on the axle d'. Thus, when a force is effective by the intermediate of the actuator 15$a_1$, the flange 19 is displaced, and through the displacement of the flange 19, the flange 20$a_1$ is affected, i.e., displaced outward from the center of the roll, and the belt mantle 11 is stretched in the direction $L_1$. As shown in FIG. 1C, the hydraulic cylinder 16 is connected at one end of the frame of the hydraulic cylinder with the mantle constructions related to the stationary axle 12. The cylinder 16 is arranged to be coupled or connected from its rod e, through an articulated joint D, with the extension arm 18 which is guided in the slide 17 connected to the axle 12. The extension arm 18 is further connected with the flange 19, which is fitted to act upon the belt mantle 11 through the flange 20$a_1$.

Figure 2B:
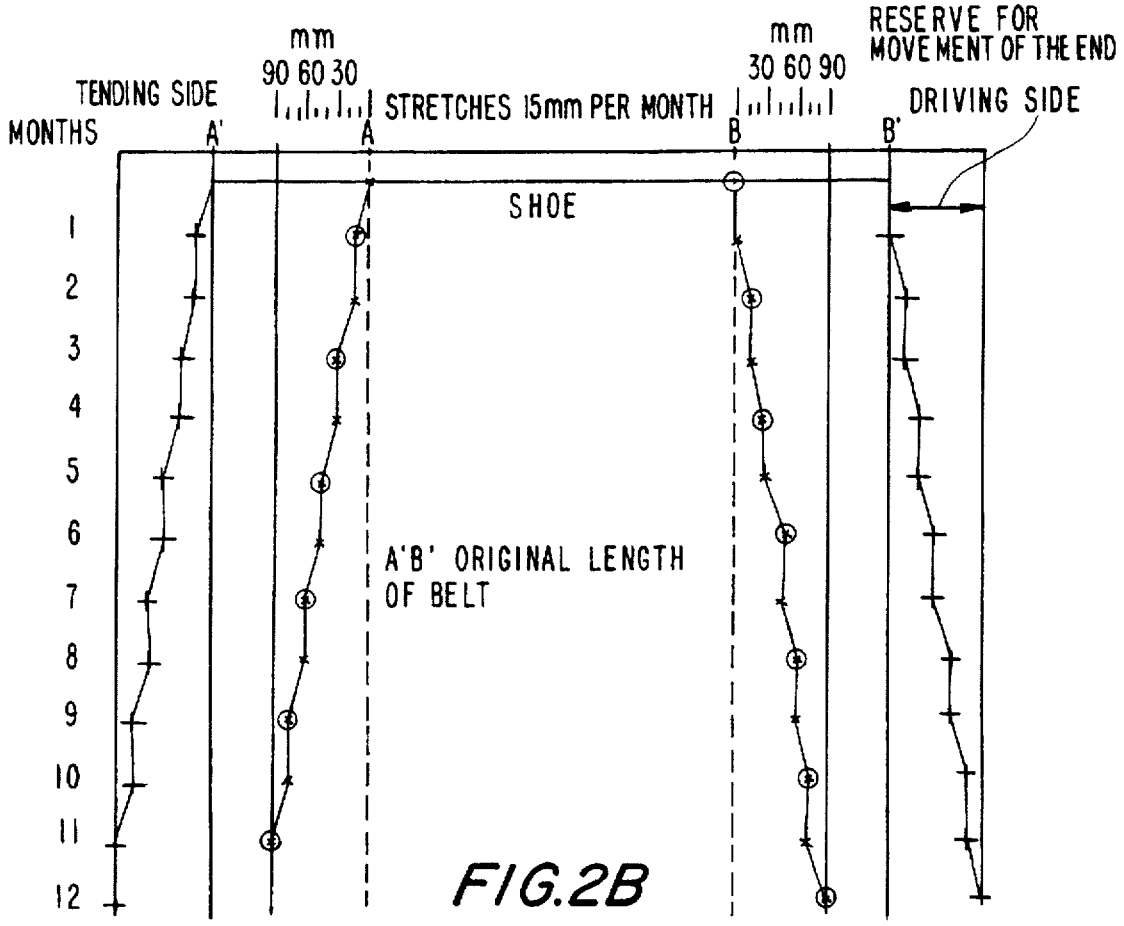
Figure 2A:
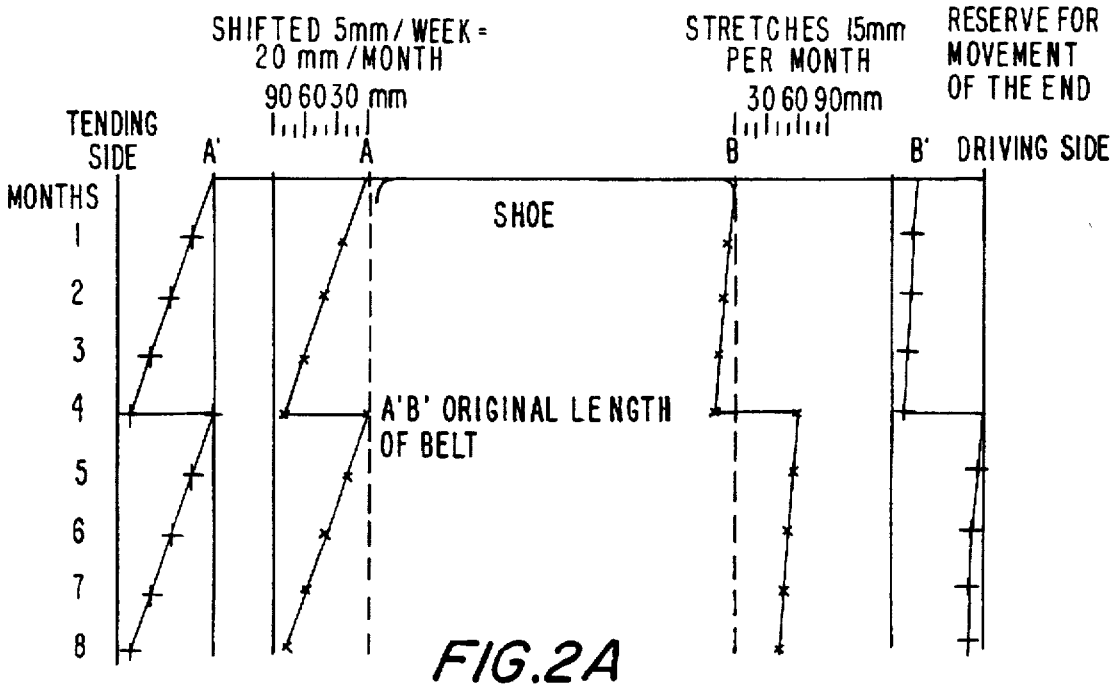
FIG.2A PRIOR ART

FIG. 2A shows a prior art belt mantle stretch/time diagram. In FIGS. 2A and 2B, the letters A and B represent certain points of the belt mantle at the ends of the loading shoe 14. The letters A' and B' represent the ends of the belt mantle. The vertical system of coordinates represents the stretch time, and the horizontal system of coordinates represents the stretch distance as millimeters. As shown in FIG. 2A, the belt mantle must be replaced after stretching of about eight months, by which time the whole adjustment reserve of the device has been consumed. In the method and arrangement in accordance with the present invention, as evidenced from the belt mantle/stretch time diagram depicted in FIG. 2B, a narrower belt mantle can be used, whereby a longer stretch distance is obtained and the entire stretch area can be utilized efficiently. Also, since opposite ends of the belt mantle 11 are stretched alternatingly, it is possible to shift the area of discontinuity between the end of the loading shoe and the belt mantle 11 to a sufficient extent, and thereby marking of the belt mantle is substantially prevented. As shown in FIG. 2B, the belt mantle is replaced after an operation of about 12 months, significantly longer than the prior art arrangement.

Figure 3A:
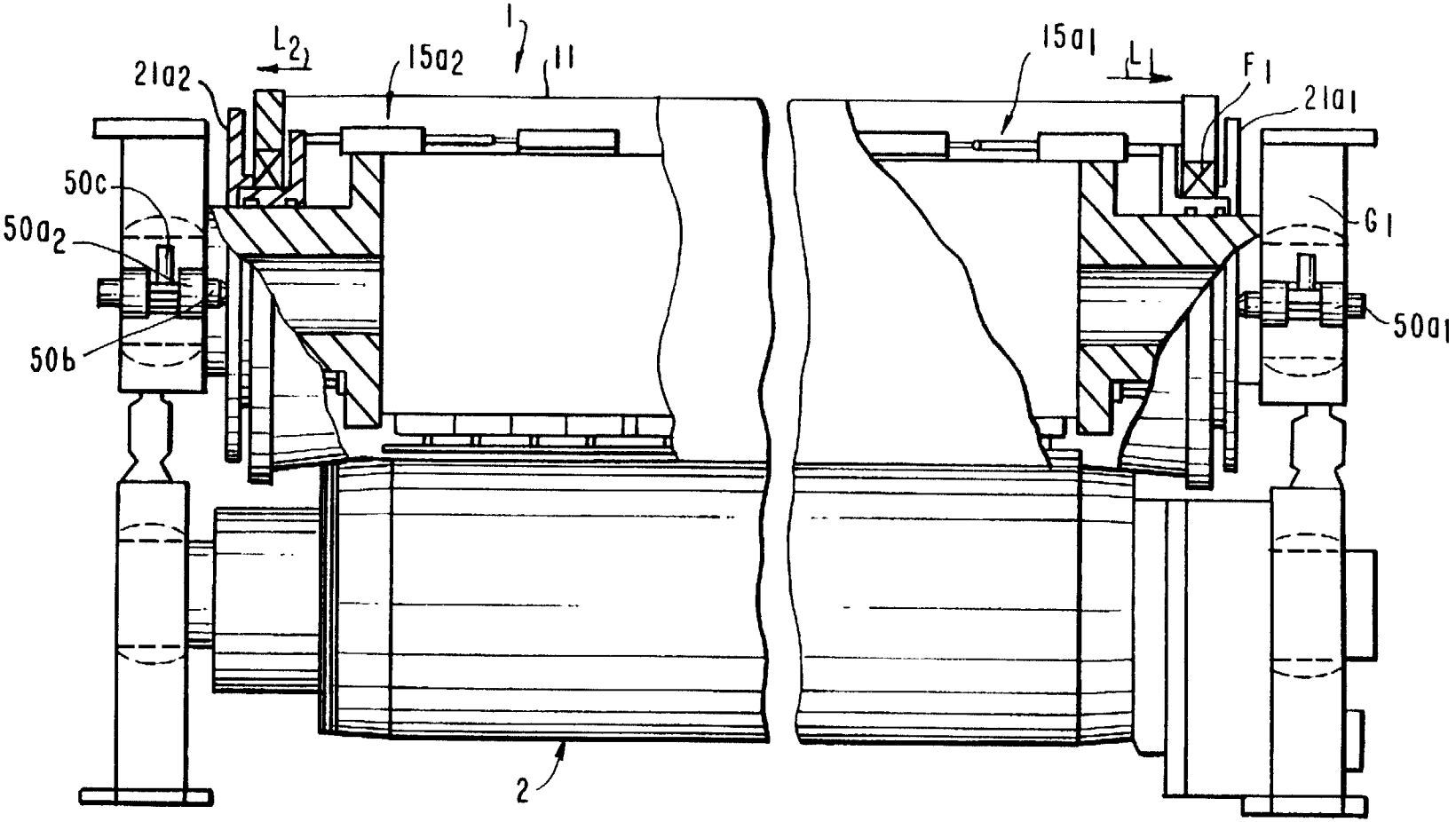
FIG. 3A shows an embodiment of the invention in which, in connection with the extended-nip roll, a lower backup roll is mounted and in which, in connection with the bearing housings $G_1$ and $G_2$, a detector device is situated, the embodiment including locking means, the spindle of the locking means at the end of the belt mantle that is locked being placed against the end flange or equivalent connected to the belt mantle.

FIG. 3A shows an embodiment in which locking means 50$a_1$,50$a_2$ and actuators, preferably loading means, such as hydraulic cylinders 15$a_1$, 15$a_2$, are used. In the embodiment shown in FIG. 3A the locking can be made very rigid. The locking takes place so that, when the belt mantle is stretched in one direction by means of the actuator(s) 15$a_2$, by means of the other actuator(s) 15$a_1$, the flange connected with the belt mantle at that side is pressed in the opposite direction against the mechanical stop of the locking device 50$a_1$ placed at that side. This prevents this side of the belt mantle from moving. The stop is a mobile spindle, 50*b* which can be locked by means of a separate locking device 50*c*, such as a cylinder device. The locking can take place, for example, so that a mechanical locking band is pressed by means of a cylinder device around the spindle 50*b*. When the direction of loading is changed, the operation is in the other respects similar except that the stretching cylinder is now the cylinder 15$a_1$, which stretches the belt mantle I 1, and the devices at the opposite side operate as locking means, in which connection the cylinder 15$a_2$ presses the flange or equivalent connected with the belt mantle against the spindle 50*b* of the locking device 50$a_2$ placed at that side. The locking device 50*a* can also be displaceable under positive control by means of a motor (as shown in FIG. 3B).

Within the scope of the invention, of course, the embodiment shown in FIG. 1B described above is possible, in which the cylinder 15$a_1$, or 15$a_2$ at one side operates as a locking cylinder only and its valve $V_1$ or $V_2$ is in a so-called locking position, whereas the cylinder at the opposite side operates as the stretching cylinder.

Within the scope of the invention, a so-called oscillating embodiment is also possible, in which exclusively cylinders are used, preferably hydraulic cylinders 15$a_1$,15$a_2$, so that to one cylinder a higher loading pressure is passed than to the other cylinder, in which case a stretching force is applied to the belt mantle 11, and, moreover, owing to this difference in pressure between the cylinders, the belt mantle 11 is displaced in the stretching direction. When the pressures in the hydraulic cylinders 15$a_1$,15$a_2$ are reversed and, correspondingly, a higher pressure is passed to one cylinder than to the other, the direction of shifting of the belt mantle is reversed and, in this way, in addition to stretching, the belt mantle 11 is also subjected to a movement of oscillation.

Figure 3B:
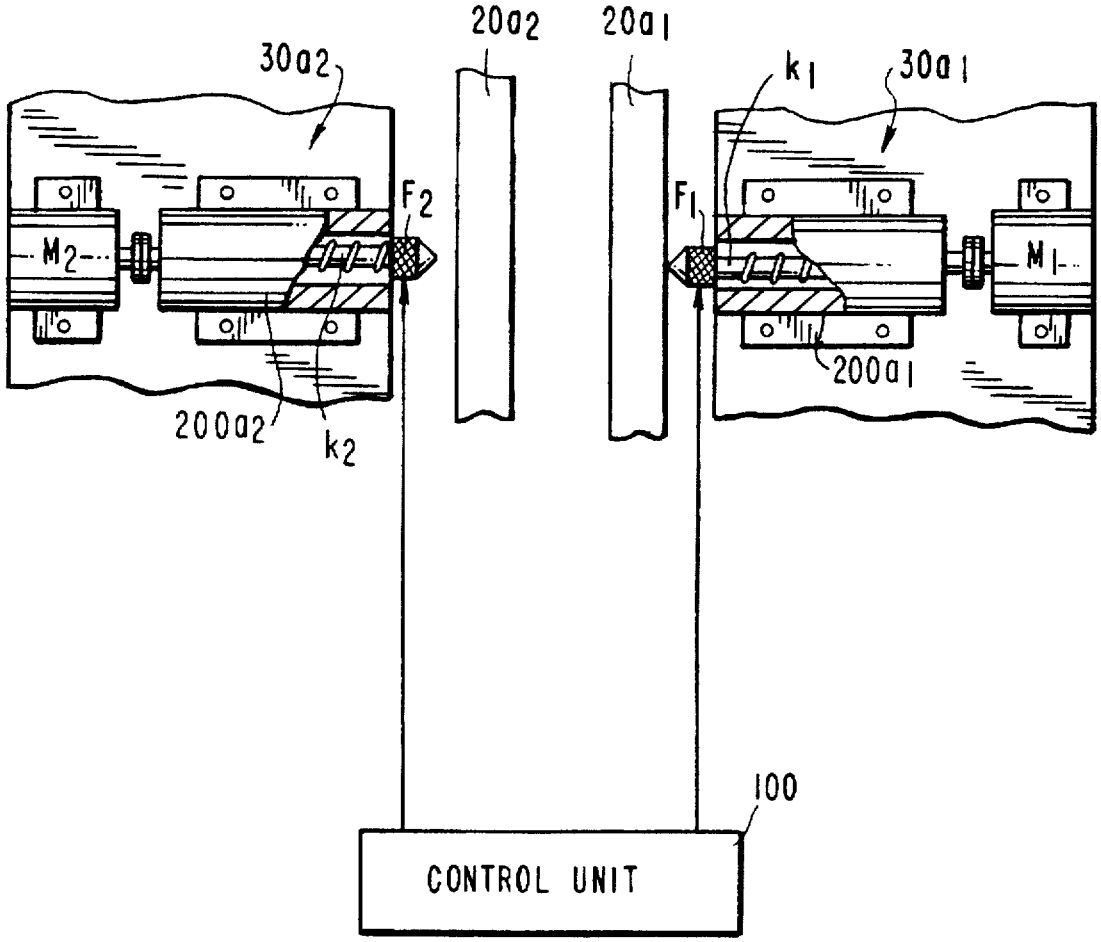
FIG. 3B illustrates a controlled shifting of the spindle.

FIG. 3B illustrates a mode of monitoring the movements of the opposite ends of an extended-nip roll. In the embodiment shown in FIG. 3B, there are positively controlled locking devices $30a_1$ and $30a_2$, which monitor the shifting of the flange part or equivalent connected with the end of the belt mantle into connection with the detector device $F_1$,$F_2$ of the locking device and transmit the information on such shifting of the flange part $20a_1$,$20a_2$ to a control unit 100 of the apparatus. After this, the control unit 100 directs a shift of a spindle $k_2$ of the locking device $30a_2$ at the other side of the belt mantle, for example, through the distance $\Delta l$=2 mm. In both actuators $15a_1$ and $15a_2$, the tightening pressures are constantly effective, and the stretching direction at each particular time is determined by the positions of the spindles $k_1$,$k_2$ of the locking devices $30a_1$ and $30a_2$.

The force detector $F_1$,$F_2$ placed in connection with the locking device $30a_1$,$30a_2$, means here, in general, a detector device in which the arrival of a flange $20a_1$ or $20a_2$ or equivalent at the location of the force detector $F_1$ or $F_2$ is detected mechanically. After a certain distance of stretch of the belt mantle 11 has been reached, through the displacement of the flange $20a_1$, the force detector $F_1$ of the locking device $30a_1$ is affected, which detector transmits the information concerning this to the control unit 100 of the device, in which connection the direction of stretching is changed and, correspondingly, the spindle $k_2$ of the other locking device $30a_2$ is displaced in view of the next cycle of monitoring measurement. The locking devices $30a_1$,$30a_2$ include motors $M_1$ and $M_2$, which rotate the spindles $k_1$ and $k_2$ in the threadings in guides $200a_1$,$200a_2$. The force detectors $F_1$ and $F_2$ are placed at the ends of the spindles $k_1$ and $k_2$. The detectors can be, for example, strain gauge detectors.

Figure 3C:
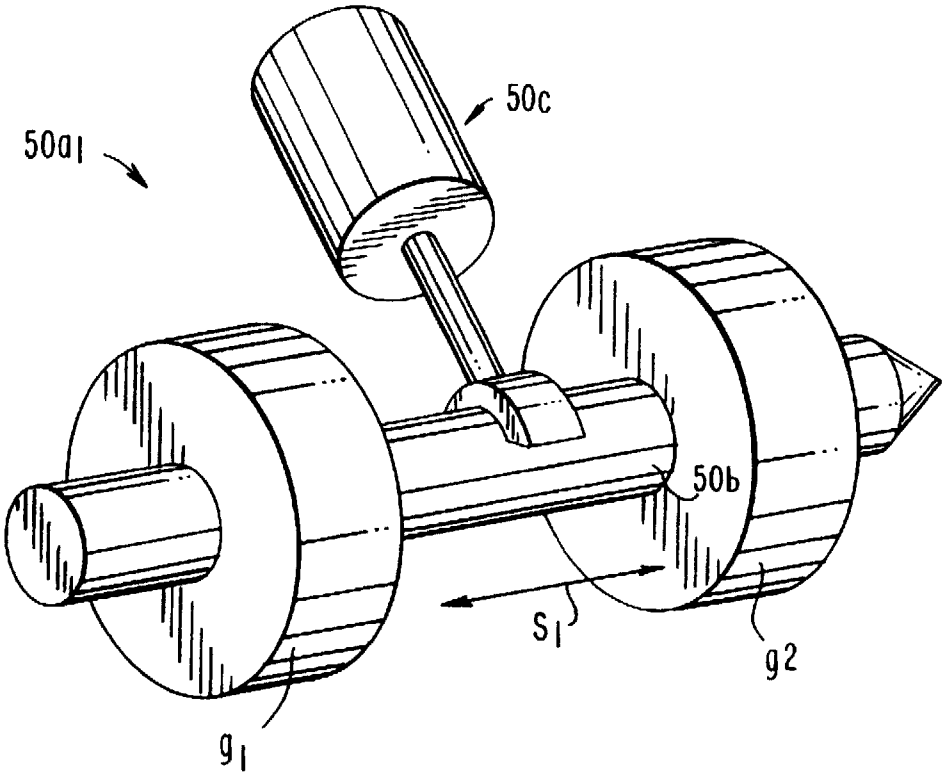
FIG. 3C illustrates the construction of principle of the locking means $50a_1$,$50a_2$ illustrated in FIG. 3A.

FIG. 3C illustrates the operations of the locking devices $50a_1$,$50a_2$. The locking devices $50a_1$,$50a_2$ each comprise a spindle **50*b*, i.e., a so-called backup pin, against which the flange $20a_1$ or $20a_2$ connected with the end of the belt mantle 11 is pressed by means of the actuator $15a_1$ or $15a_2$. The spindle 50*b* can be displaced in the direction of the arrow $S_1$. As shown in FIG. 3C, the spindle 50*b* can be locked mechanically by means of the locking device 50*c* in a fixed position. The locking device 50*c* can be, for example, a hydraulic actuator, such as a hydraulic cylinder. The separate spindle 50*b* can be displaced on support of bearing means $g_1$,$g_2$. An embodiment is also possible in which the spindle can be connected from its end to the displaceable flange $21a_1$ or $21a_2$ of the extended-nip roll 11. Thus, in this possible embodiment, the spindle 50*b* moves along with the flange $21a_1$,$21a_2$ or with any other mobile construction which is connected with the belt mantle. Also in this embodiment, the spindle 50*b* can be locked mechanically by means of a locking device 50*c*, preferably a hydraulic actuator, such as a hydraulic cylinder, in the desired position, after which the flange $21a_1$,$21a_2$ connected with the end of the belt mantle or any other construction connected with the belt mantle 11 can be pressed against the spindle 50*b*. In such a case, the locking of the end of the belt mantle 11** is as efficient as possible.

The spindle **50*b* can also be displaceable by means of a separate motor (not shown in FIG. 3C). In such a case, the end of the spindle 50*b*** is not connected with the flange $21a_1$ or $21a_2$, of the extended-nip roll or with any other mobile construction connected with the belt mantle, but it can be shifted by means of the motor to the desired position.

Figure 4B:
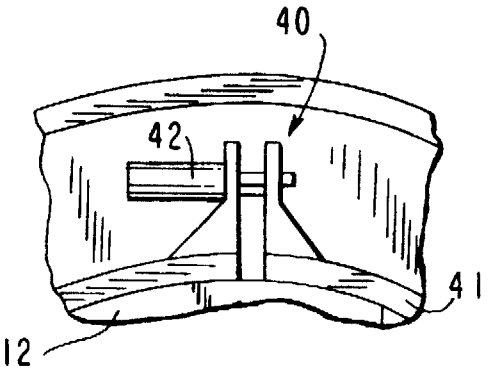
FIG. 4B is a sectional view taken along the line I—I in FIG. 4A.
Figure 4A:
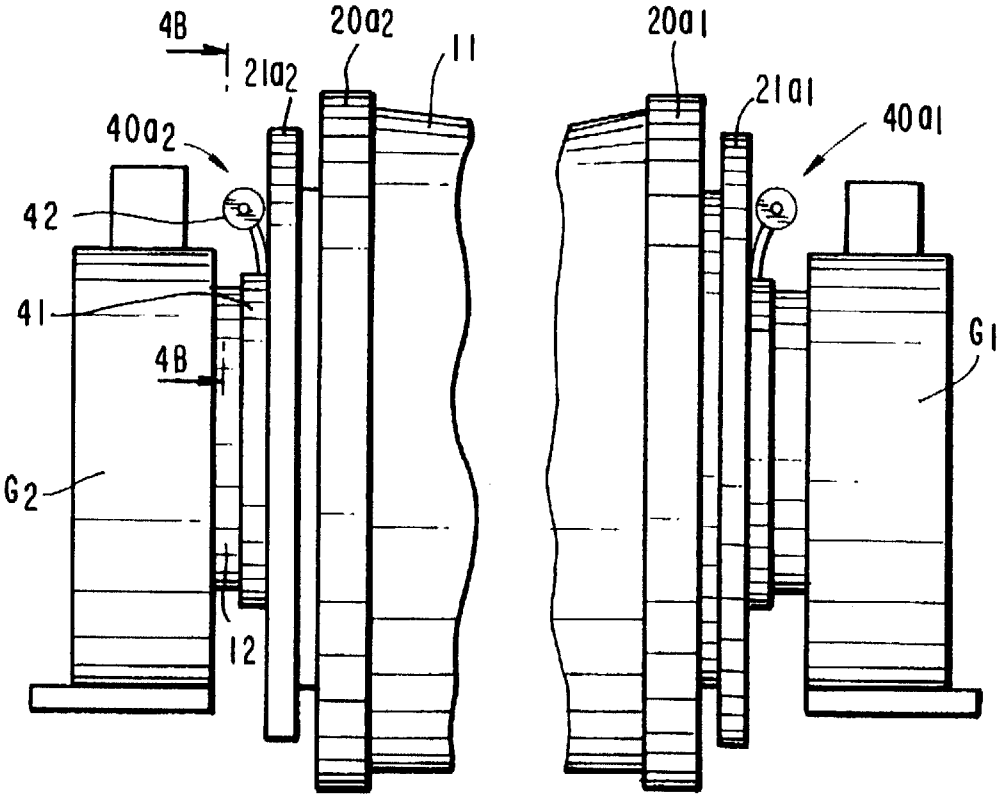
FIG. 4A shows an embodiment of locking in which the locking is carried out by means of a locking band connected with a displaceable flange.

FIG. 4A shows a second embodiment for locking one end of the belt mantle 11 for the time of stretching of the belt mantle 11. Specifically, the construction of the locking device $40a_1$,$40a_2$ is shown. The locking devices $40a_1$,$40a_2$ each comprise a band 41 which surrounds the stationary axle 12 and is situated outward in an axial direction from and adjacent to the respective flange. The locking device $40a_1$ is fixed to the flange $21a_1$. Similarly, at the opposite end of the belt-mantle roll, there is a similar locking device $40a_2$ which is fixed to the flange $20a_2$. When locking is carried out by means of the locking device $40a_1$, the band 41 is affected by means of a hydraulic actuator 42 so that the band 41 is tightened around the axle 12 (FIG. 4B). In this manner, the band 41 is locked in relation to the axle 12 and locks the construction so that one end of the belt mantle 11 cannot move by the effect of the actuators, preferably power units $15a_1$ or $15a_2$. The locking devices $40a_1$,$40a_2$ are placed in a corresponding way at opposite ends of the belt mantle 11. When one locking device $40a_1$ is locked, both ends of the belt mantle are acted upon by means of the power units $15a_1$, $15a_2$, or one end is acted upon by means of the power unit $15a_1$ in a manner for stretching the belt mantle 11, and similarly, when the stretching direction is reversed, both ends of the belt mantle are acted upon by means of the power units $15a_1$, $15a_2$, or one end of the belt mantle is acted upon by means of the other power units $15a_2$, and correspondingly, the locking device $40a_2$ at the other side is locked.

Both actuators $15a_1$,$15a_2$ can be affected constantly and continuously. The stretching direction is determined by the locking devices $40a_1$,$40a_2$. It is a possible construction also in this case and in the cases shown in FIGS. 3A and 3B that the hydraulic system of loading of the actuators $15a_1$, $15a_2$ at the immobile end is locked.

FIG. 4B is a partial sectional view of the locking device taken along the line I—I in FIG. 4A. When the actuator 42 is affected, the band 41 is tightened around the axle 12 and locks the flange $21a_1$ connected with the band and, further, the belt mantle 11 connected with the flange, immobile in relation to the axle 12. The flange $21a_1$ on which the locking device $40a_1$,$40a_2$ is suspended, is further connected with the flange $20a_1$, with which the belt mantle 11 is connected. The arrangement is similar in the case of the flange $21a_2$. The flange $21a_2$ is connected with the flange $20a_2$ connected with the belt mantle 11.

Figures 5A, 5B:
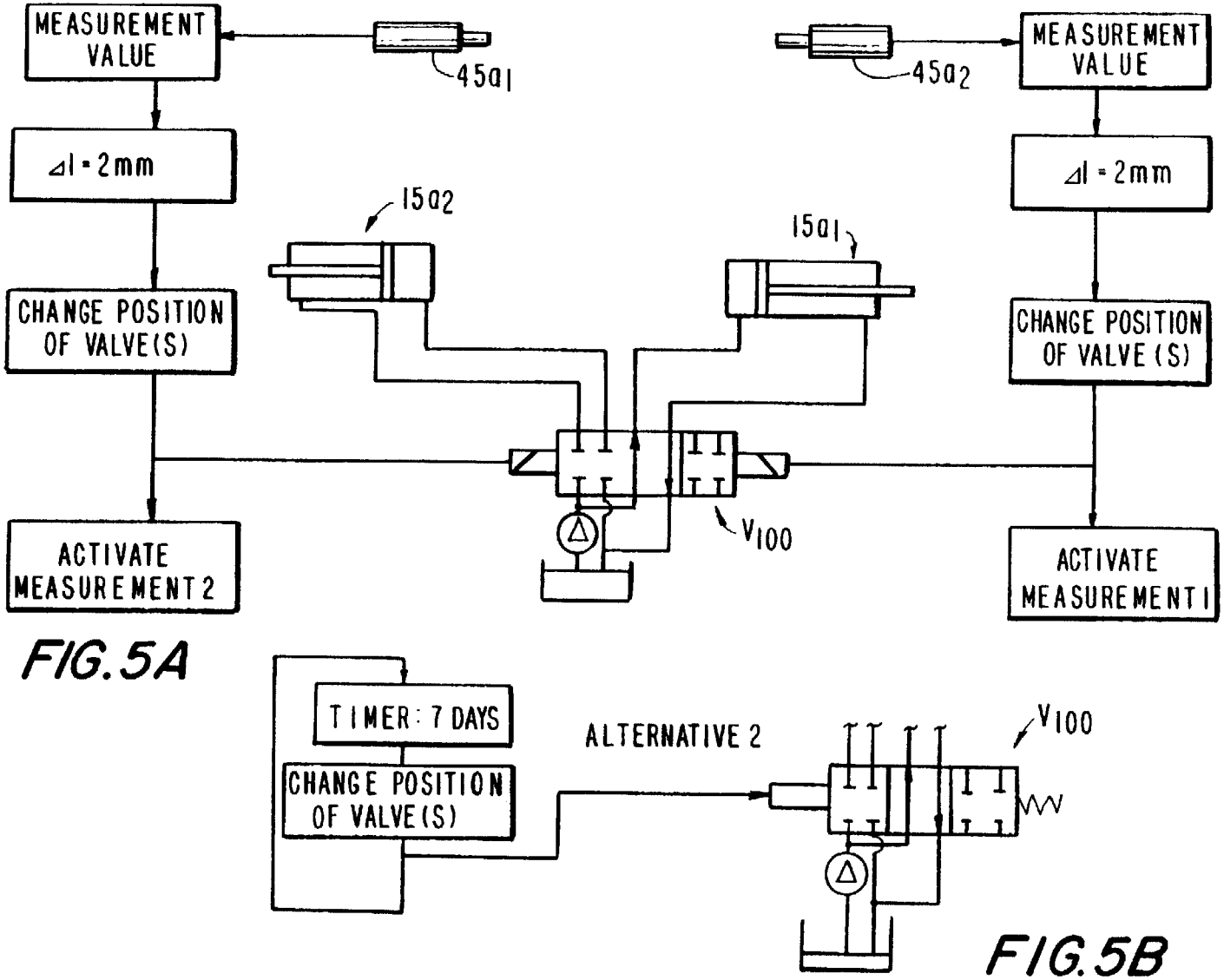
FIG. 5A is a block diagram illustration of the method in accordance with the invention in stretching of the belt mantle.
FIG. 5B illustrates a second, alternative embodiment of the invention, in which the mode of operation in respect of the actuators $15a_1$, $15a_2$ is changed automatically after a certain period of time.

FIG. 5A illustrates the measurement and loading process in accordance with the invention. By means of the measurement detectors $45a_1$,$45a_2$, the position of one end flange of the extended-nip roll 1 is monitored and, for example, if a shifting of 2 mm is noticed in the end flange, by means of the selective positioning of flow passages of the valve device $V_{100}$, the actuators at the side B are switched on to operation, and the actuators at the side A are switched out of operation. Similarly, at the opposite end of the belt mantle of the extended-nip roll, there are similar detecting means, and the detecting at this side takes place in a corresponding manner. When the distance of movement of the end has been noticed to be, for example, $\Delta l$=2 mm, the position of the valve $V_{100}$ is changed, and the actuators at the side A are activated again and the actuators at the side B are locked.

FIG. 5A illustrates an embodiment of the valve $V_{100}$. It is obvious that, in the case of the device, for example, the construction shown in FIG. 1B can be used, in which there are separate valves, $V_1$ and $V_2$, for the actuators $15a_1$ and $15a_2$. In such a case, in the embodiment, the first valve block connects the flows crosswise, and the second valve block shifts the cylinder in the opposite direction, and the third block is a so-called locking block.

FIG. 5B shows a second alternative, in which the actuators, i.e., the power units $15a$ and $15a_2$ are switched on under time control, for example, at intervals of 7 days. Thus, always after 7 days, the mode of operation of the actuators $15a_1$, $15a_2$ is changed so that, for example, the actuators $15a_1$ act upon the belt mantle with a force and the actuator $15a_2$ is locked, and after 7 days the valve $V_{100}$ is controlled so that the actuator $15a_1$ is locked and the actuator $15a_2$ acts upon the other end of the belt with a force. Any other suitable time durations for operating the actuators can also be used.

Thus, according to the invention, the operation of the actuators, preferably power units $15a_1$,$15a_2$, is changed automatically after a certain period of time. When one power unit $15a_1$ is loaded, the other power unit $15a_2$ is locked, and vice versa. The loading direction and stretching direction is the axial direction of the belt mantle, i.e., perpendicular to the machine direction of the paper/board machine. Similarly, the power units $15a_1$, $15a_2$ can be operated so that, instead of the loading time, the distance of stretching of the belt mantle 11 is monitored, and based on that distance the actuators $15a_1$,$15a_2$, which are preferably hydraulic cylinders, are regulated. After a certain distance of stretching, the direction of loading is reversed, i.e., one set of loading means $15a_1$ or $15a_2$ is switched on to operation and the other set of loading means $15a_1$ or $15a_2$ is switched off to the locked state.

Figures 6A, 6B:
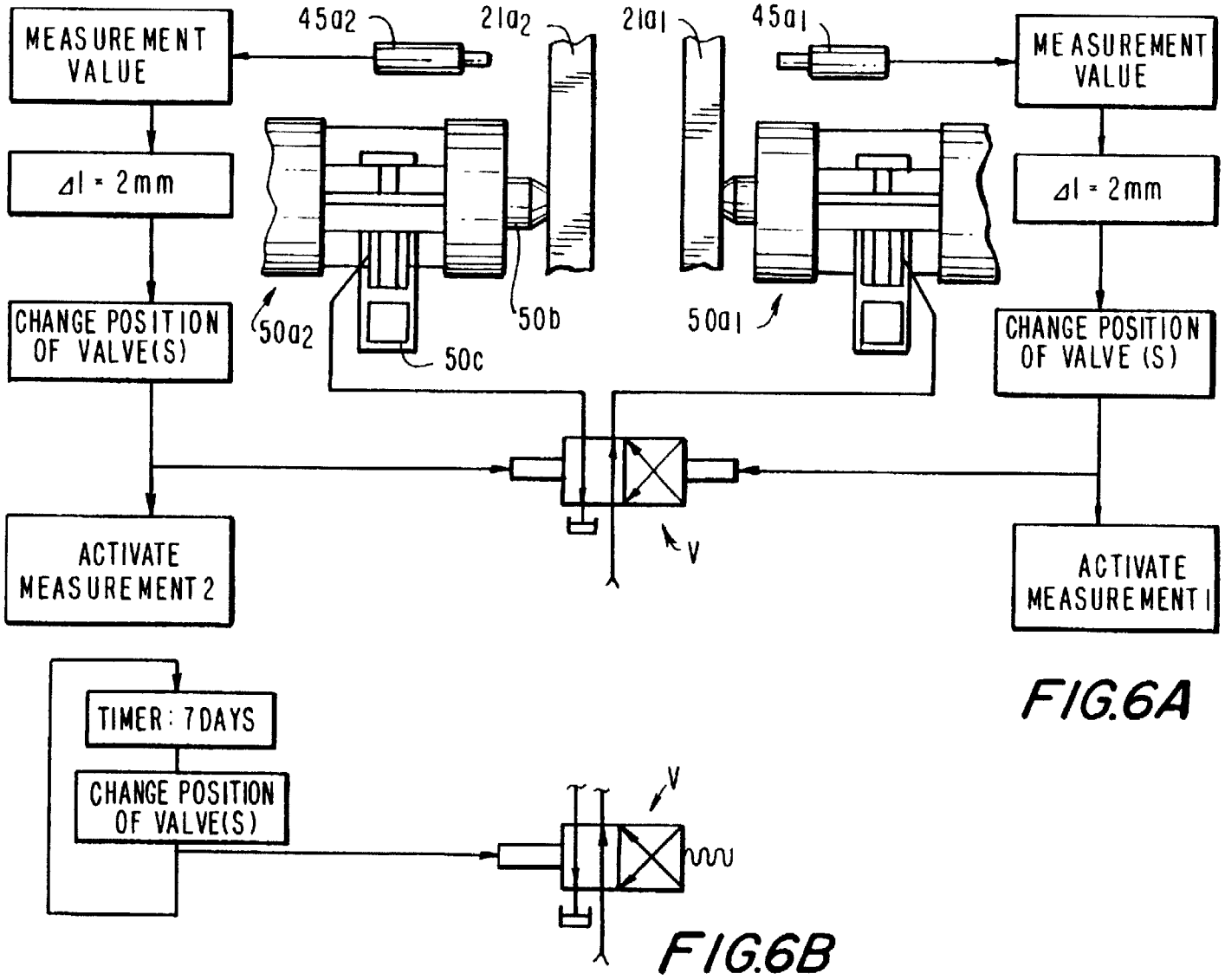
FIG. 6A illustrates a position in the other respects corresponding to FIG. 5A, but in the embodiment of this figure the locking means are regulated/controlled.
FIG. 6B corresponds to the embodiment shown in FIG. 5B, but the control takes place so that the locking means are controlled, the loading cylinders connected to the ends of the belt mantle optionally being subjected to a constant loading in compliance with the description related to FIG. 3A.

FIG. 6A shows an embodiment in other respects corresponding to FIG. 5A. The embodiment shown in FIG. 6A corresponds to the case of FIG. 3A, in which a separate locking device $50a_1$,$50a_2$ is used. The pressures in the loading cylinders $15a_1$, $15a_2$ can be maintained constantly, and the effect of the force and the stretching direction are reversed by acting upon the locking devices $50a_1$,$50a_2$ shown in FIG. 6A. When the block in the valve V is changed, the locking side of the ends of the belt mantle 11 is changed. One of the locking devices $50a_1$,$50a_2$ is locked, the other one is not locked. When the locking is changed from one locking device to the other, the direction of stretching of the belt mantle 11 is reversed.

FIG. 6B shows an embodiment in which the change in the stretching direction takes place automatically after a certain period of time, e.g., seven (7) days, so that, by means of the valve V, the locking devices $50a_1$,$50a_2$ are affected so that the spindle 50*b* of one locking device is shifted so that it reaches contact with a construction connected with the belt mantle 11, such as the flange $20a_1$ or $20a_2$. After this the spindle 50*b* is locked. Similarly, the spindle 50*b* of the locking device at the opposite side is released from the locking in relation to the flange $20a_1$ or $20a_2$ or some other construction connected with the belt mantle 11. In such a case, the stretching direction is reversed. One end of the belt mantle 11 is released from locking and the other end is locked, whereby the direction of stretching is reversed.

The examples provided above are not meant to be exclusive. Many other variations of the present invention would be obvious to those skilled in the art, and are contemplated to be within the scope of the appended claims.

I claim:

1. A method for reducing wear of a resilient belt mantle of an extended-nip roll including a stationary central axle, bearings for revolvingly supporting the belt mantle on the central axle, a loading shoe arranged in the belt mantle, and loading means arranged on the central axle for pressing the loading shoe toward a backup roll arranged in nip-defining relationship with the extended-nip roll, comprising the steps of:

coupling a first set of at least one actuator to a first end of the belt mantle, said at least one actuator in said first set being actuatable to apply a force to the first end of the belt mantle such that the belt mantle is stretchable in a first direction, coupling a second set of at least one actuator to a second end of the belt mantle, said at least one actuator in said second set being actuatable to apply a force to the second end of the belt mantle such that the belt mantle is stretchable in a second direction opposite to said first direction, controlling the actuation of said at least one actuator in said first set and said at least one actuator in said second set such that the belt mantle is alternatingly stretched in the first direction and the second direction, said step of controlling said at least one actuator in said first set and said at least one actuator in said second set comprises the steps of:

locking the first end of the belt mantle when said at least one actuator in said second set is actuated and locking the second end of the belt mantle when said at least one actuator in said first set is actuated.

2. The method of claim 1, wherein the step of controlling said at least one actuator in said first set and said at least one actuator in said second set further comprises the steps of:

actuating said at least one actuator in said first set to stretch the web in the first direction, stopping the actuation of said at least one actuator in said first set after the belt mantle has been stretched a first distance in the first direction, actuating said at least one actuator in said second set to stretch the web in the second direction after the actuation of said at least one actuator in said first set has been stopped, and stopping the actuation of said at least one actuator in said second set after the belt mantle has been stretched a second distance in the second direction.

3. The method of claim 1, wherein the step of controlling said at least one actuator in said first set and said at least one actuator in said second set further comprises the steps of:

actuating said at least one actuator in said first set to stretch the web in the first direction for a first time duration, stopping the actuation of said at least one actuator in said first set after the belt mantle has been stretched in the first direction for the first time duration, actuating said at least one actuator in said second set to stretch the web in the second direction for a second time duration after the actuation of said at least one actuator in said first set has been stopped, and stopping the actuation of said at least one actuator in said second set after the belt mantle has been stretched in the second direction for the second time duration.

4. The method of claim 1, wherein the step of controlling said at least one actuator in said first set and said at least one actuator in said second set further comprises the steps of:

initially locking the second end of the belt mantle, actuating said at least one actuator in said first set to stretch the web in the first direction while the second end of the belt mantle is locked, stopping the actuation of said at least one actuator in said first set after the belt mantle has been stretched a first distance in the first direction, releasing the locking of the second end of the belt mantle after the actuation of said at least one actuator in said first set has been stopped, locking the first end of the belt mantle after the actuation of said at least one actuator in said first set has been stopped, actuating said at least one actuator in said second set to stretch the web in the second direction after the actuation of said at least one actuator in said first set has been stopped and while the first end of the belt mantle is locked, and stopping the actuation of said at least one actuator in said second set after the belt mantle has been stretched a second distance in the second direction.

5. The method of claim 1, wherein the step of controlling said at least one actuator in said first set and said at least one actuator in said second set further comprises the steps of:

initially locking the second end of the belt mantle, actuating said at least one actuator in said first set to stretch the web in the first direction for a first time duration while the second end of the belt mantle is locked, stopping the actuation of said at least one actuator in said first set after the belt mantle has been stretched in the first direction for the first time duration, releasing the locking of the second end of the belt mantle after the actuation of said at least one actuator in said first set has been stopped, locking the first end of the belt mantle after the actuation of said at least one actuator in said first set has been stopped, actuating said at least one actuator in said second set to stretch the web in the second direction for a second time duration after the actuation of said at least one actuator in said first set has been stopped and while the first end of the belt mantle is locked, and stopping the actuation of said at least one actuator in said second set after the belt mantle has been stretched in the second direction for the second time duration.

6. The method of claim 1, further comprising the steps of:

arranging a first flange at a first axial end of the central axle for retaining the first end of the belt mantle, said first flange being arranged on the central axle, said at least one actuator in said first set being arranged to apply a force upon actuation to said first flange, and arranging a second flange at a second axial end of the central axle for retaining the second end of the belt mantle, said second flange being arranged on the central axle, said at least one actuator in said second set being arranged to apply a force upon actuation to said second flange.

7. The method of claim 6, wherein the step of locking the first end of the belt mantle when said at least one actuator in said second set is actuated comprises the step of locking said first flange in its position when said at least one actuator in said second set is actuated, and the step of locking the second end of the belt mantle when said at least one actuator in said first set is actuated comprises the step of locking said second flange in its position when said at least one actuator in said first set is actuated.

8. The method of claim 7, wherein the step of locking said first flange in its position comprises the step of tightening a first band around the central axle, outward in an axial direction from and adjacent to said first flange and the step of locking said second flange in its position comprises the step of tightening a second band around the central axle outward in an axial direction from and adjacent to said second flange.

9. The method of claim 7, wherein the step of locking said first flange in its position comprises the step of actuating said at least one actuator in said first set to press said first flange against a first stop spindle and the step of locking the second flange in its position comprises the step of actuating said at least one actuator in said second set to press the second flange against a second stop spindle.

10. The method of claim 1, wherein said at least one actuator in said first set and said at least one actuator in said second set comprise hydraulic actuators, said actuators having an actuated position in which the associated end of the belt mantle is pulled to stretch the belt mantle and a locked position in which movement of the associated end of the belt mantle is prevented.

11. The method of claim 1, further comprising the steps of:

arranging a first flange at a first axial end of the central axle for retaining the first end of the belt mantle, said first flange being arranged on the central axle, said at least one actuator in said first set being arranged to apply a force upon actuation to said first flange, arranging a second flange at a second axial end of the central axle for retaining the second end of the belt mantle, said second flange being arranged on the central axle, said at least one actuator in said second set being arranged to apply a force upon actuation to said second flange, and monitoring stretching of the belt mantle by detecting the displacement of said first and second flanges.

12. The method of claim 11, wherein the step of monitoring stretching of the belt mantle comprises the steps of:

supplying a medium to said at least one actuator in said first set through a valve to actuate said at least one actuator in said first set, supplying a medium to said at least one actuator in said second set through said valve to actuate said at least one actuator in said second set, and controlling said valve such that when the medium flows to said at least one actuator in said first set, flow of the medium to said at least one actuator in said second set is prevented and said at least one actuator in said second set is locked and when the medium flows to said at least one actuator in said second set, flow of the medium to said at least one actuator in said first set is prevented and said at least one actuator in said first set is locked.

13. The method of claim 1, wherein said at least one actuator in said first set and said at least one actuator in said second set comprises hydraulic cylinders actuated by means of a loading pressure provided by a hydraulic medium, the step of controlling said at least one actuator in said first set and said at least one actuator in said second set further comprising the steps of:

actuating said at least one hydraulic cylinder in said first set and said at least one hydraulic cylinder in said second set simultaneously, applying a lower loading pressure of the hydraulic medium to said at least one hydraulic cylinder in said first set than to said at least one hydraulic cylinder in said second set such that the belt mantle is displaced and stretched in the second direction by the greater force applied by said at least one hydraulic cylinder in said second set with respect to the force applied by said at least one hydraulic cylinder in said first set, and reversing the direction of displacement and stretching of the belt mantle by changing the loading pressures applied to the hydraulic cylinders in said first and second sets.

14. In an extended nip comprising a back-up roll and an extended-nip roll arranged in nip-defining relationship with the back-up roll and including stationary central axle, a belt mantle surrounding the central axle, first and second flanges for retaining respective first and second ends of the belt mantle, bearings for revolvingly supporting the first and second flanges on the central axle, at least one loading shoe arranged in the belt mantle, and loading means arranged on the central axle for pressing the loading shoe toward the backup roll, the improvement comprising an apparatus for reducing the wear of the belt mantle comprising a first set of at least one actuator coupled to the first end of the belt mantle for loading the belt mantle to stretch the belt mantle in a first direction, and a second set of at least one actuator coupled to the second end of the belt mantle for loading the belt mantle to stretch the belt mantle in a second direction opposite to the first direction, said at least one actuator in said first set and said at least one actuator in said second set being structured and arranged to alternatingly stretch the belt mantle in the first direction and the second direction, said at least one actuator in said first set and said at least one actuator in said second set each comprising a hydraulic actuator having an actuated condition in which the associated end of the belt mantle is pulled to stretch the belt mantle and a locked condition in which movement of the associated end of the belt mantle is prevented.

15. The apparatus of claim 14, further comprising detection means for monitoring the stretching of the belt mantle and controlling said at least one actuator in said first set and said at least one actuator in said second set to change the direction of stretching of the belt mantle.

16. The apparatus of claim 15 further comprising at least one valve coupled to said at least one actuator in said first set and said at least one actuator in said second set for supplying hydraulic pressure medium to actuate said at least one actuator in said first set and said at least one actuator in said second set, said detection means controlling the supply of the hydraulic pressure medium to said at least one actuator in said first set and said at least one actuator in said second set via said at least one valve.

17. The apparatus of claim 15, wherein said detection means comprise a force detector.

18. The apparatus of claim 15, further comprising first locking means for locking said first end of the belt mantle and second locking means for locking said second end of the belt mantle, said detection means being structured and arranged to control said first and second locking means.

19. The apparatus of claim 14, wherein said at least one hydraulic actuator in said first set and said at least one hydraulic actuator in said second set each comprise a hydraulic cylinder, said at least one hydraulic cylinder in said first set being connected to said first flange and being oriented in a direction substantially parallel to the central axle, said at least one hydraulic cylinder in said second set being connected to said second flange and being oriented in a direction substantially parallel to the central axle, said first and second flanges being arranged to glide on said central axle.

20. The apparatus of claim 19, further comprising detection means for monitoring the stretching of the belt mantle, said detection means comprising inductive detectors structured and arranged to detect the position of said first and second flanges.

21. A method for reducing wear of a resilient belt mantle of an extended-nip roll including a stationary central axle, bearings for revolvingly supporting the belt mantle on the central axle, a loading shoe arranged in the belt mantle, and loading means arranged on the central axle for pressing the loading shoe toward a backup roll arranged in nip-defining relationship with the extended-nip roll, comprising the steps of:

coupling a first set of at least one actuator to a first end of the belt mantle, said at least one actuator in said first set being actuatable to apply a force to the first end of the belt mantle such that the belt mantle is stretchable in a first direction, coupling a second set of at least one actuator to a second end of the belt mantle, said at least one actuator in said second set being actuatable to apply a force to the second end of the belt mantle such that the belt mantle is stretchable in a second direction opposite to said first direction, controlling the actuation of said at least one actuator in said first set and said at least one actuator in said second set such that the belt mantle is alternatingly stretched in the first direction and the second direction, the step of controlling the actuation of said at least one actuator in said first set and said at least one actuator in said second set comprising the steps of:

locking the second end of the belt mantle, actuating said at least one actuator in said first set to stretch the web in the first direction while the second end of the belt mantle is locked, stopping the actuation of said at least one actuator in said first set after the belt mantle has been stretched a first distance in the first direction, releasing the locking of the second end of the belt mantle after the actuation of said at least one actuator in said first set has been stopped, locking the first end of the belt mantle after the actuation of said at least one actuator in said first set has been stopped, actuating said at least one actuator in said second set to stretch the web in the second direction after the actuation of said at least one actuator in said first set has been stopped and while the first end of the belt mantle is locked, and stopping the actuation of said at least one actuator in said second set after the belt mantle has been stretched a second distance in the second direction.

22. A method for reducing wear of a resilient belt mantle of an extended-nip roll including a stationary central axle, bearings for revolvingly supporting the belt mantle on the central axle, a loading shoe arranged in the belt mantle, and loading means arranged on the central axle for pressing the loading shoe toward a backup roll arranged in nip-defining relationship with the extended-nip roll, comprising the steps of:

coupling a first set of at least one actuator to a first end of the belt mantle, said at least one actuator in said first set being actuatable to apply a force to the first end of the belt mantle such that the belt mantle is stretchable in a first direction, coupling a second set of at least one actuator to a second end of the belt mantle, said at least one actuator in said second set being actuatable to apply a force to the second end of the belt mantle such that the belt mantle is stretchable in a second direction opposite to said first direction, controlling the actuation of said at least one actuator in said first set and said at least one actuator in said second set such that the belt mantle is alternatingly stretched in the first direction and the second direction.

the step of controlling the actuation of said at least one actuator in said first set and said at least one actuator in said second set comprising the steps of:

locking the second end of the belt mantle.

actuating said at least one actuator in said first set to stretch the web in the first direction for a first time duration while the second end of the belt mantle is locked.

stopping the actuation of said at least one actuator in said first set after the belt mantle has been stretched in the first direction for the first time duration.

releasing the locking of the second end of the belt mantle after the actuation of said at least one actuator in said first set has been stopped.

locking the first end of the belt mantle after the actuation of said at least one actuator in said first set has been stopped.

actuating said at least one actuator in said second set to stretch the web in the second direction for a second time duration after the actuation of said at least one actuator in said first set has been stopped and while the first end of the belt mantle is locked, and stopping the actuation of said at least one actuator in said second set after the belt mantle has been stretched in the second direction for the second time duration.

23. A method for reducing wear of a resilient belt mantle of an extended-nip roll including a stationary central axle, bearings for revolvingly supporting the belt mantle on the central axle, a loading shoe arranged in the belt mantle, and loading means arranged on the central axle for pressing the loading shoe toward a backup roll arranged in nip-defining relationship with the extended-nip roll, comprising the steps of coupling a first set of at least one actuator to a first end of the belt mantle, said at least one actuator in said first set being actuatable to apply a force to the first end of the belt mantle such that the belt mantle is stretchable in a first direction.

coupling a second set of at least one actuator to a second end of the belt mantle, said at least one actuator in said second set being actuatable to apply a force to the second end of the belt mantle such that the belt mantle is stretchable in a second direction opposite to said first direction.

controlling the actuation of said at least one actuator in said first set and said at least one actuator in said second set such that the belt mantle is alternatingly stretched in the first direction and the second direction.

arranging a first flange at a first axial end of the central axle for retaining the first end of the belt mantle, said first flange being arranged on the central axle, said at least one actuator in said first set being arranged to apply a force upon actuation to said first flange.

arranging a second flange at a second axial end of the central axle for retaining the second end of the belt mantle, said second flange being arranged on the central axle, said at least one actuator in said second set being arranged to apply a force upon actuation to said second flange.

locking said first flange in its position when said at least one actuator in said second set is actuated, and locking said second flange in its position when said at least one actuator in said first set is actuated.

24. The method of claim 23, wherein the step of locking said first flange in its position comprises the step of tightening a first band around the central axle, outward in an axial direction from and adjacent to said first flange and the step of locking said second flange in its position comprises the step of tightening a second band around the central axle outward in an axial direction from and adjacent to said second flange.

25. The method of claim 23, wherein the step of locking said first flange in its position comprises the step of actuating said at least one actuator in said first set to press said first flange against a first stop spindle and the step of locking the second flange in its position comprises the step of actuating said at least one actuator in said second set to press the second flange against a second stop spindle.

26. A method for reducing wear of a resilient belt mantle of an extended-nip roll including a stationary central axle, bearings for revolvingly supporting the belt mantle on the central axle, a loading shoe arranged in the belt mantle, and loading means arranged on the central axle for pressing the loading shoe toward a backup roll arranged in nip-defining relationship with the extended-nip roll, comprising the steps of:

coupling a first set of at least one actuator to a first end of the belt mantle, said at least one actuator in said first set being actuatable to apply a force to the first end of the belt mantle such that the belt mantle is stretchable in a first direction.

coupling a second set of at least one actuator to a second end of the belt mantle, said at least one actuator in said second set being actuatable to apply a force to the second end of the belt mantle such that the belt mantle is stretchable in a second direction opposite to said first direction, and controlling the actuation of said at least one actuator in said first set and said at least one actuator in said second set such that the belt mantle is alternatingly stretched in the first direction and the second direction.

said at least one actuator in said first set and said at least one actuator in said second set comprising hydraulic actuators having an actuated condition in which the associated end of the belt mantle is pulled to stretch the belt mantle and a locked condition in which movement of the associated end of the belt mantle is prevented.

* * * * *